US010023980B2

(12) United States Patent
Winzen

(10) Patent No.: US 10,023,980 B2
(45) Date of Patent: Jul. 17, 2018

(54) SPINNING ROTOR FOR AN OPEN-END-SPINNING DEVICE OPERATING AT HIGH ROTOR SPEEDS

(71) Applicant: Saurer Germany GmbH & Co. KG, Remscheid (DE)

(72) Inventor: Lothar Winzen, Herzogenrath (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 44 days.

(21) Appl. No.: 15/155,438

(22) Filed: May 16, 2016

(65) Prior Publication Data

US 2016/0369429 A1 Dec. 22, 2016

(30) Foreign Application Priority Data

Jun. 18, 2015 (DE) ..... 10 2015 007 819

(51) Int. Cl.
*D01H 4/10* (2006.01)

(52) U.S. Cl.
CPC ..... *D01H 4/10* (2013.01)

(58) Field of Classification Search
CPC .. D01H 4/08; D01H 4/10; D01H 4/12; D01H 4/14
USPC ..... 57/406
See application file for complete search history.

(56) References Cited

U.S. PATENT DOCUMENTS 3,798,887 A * 3/1974 Le Chatelier ..... D01H 4/10 57/414
4,050,235 A * 9/1977 Neubert ..... D01H 4/10 57/416
4,058,964 A * 11/1977 Stalder ..... D01H 4/10 57/416
4,068,456 A * 1/1978 Landwehrkamp ..... D01H 4/10 57/417
4,078,370 A * 3/1978 Dreger ..... D01H 4/10 57/302
4,172,357 A * 10/1979 Stahlecker ..... D01H 4/10 57/263
4,237,682 A * 12/1980 Miyamoto ..... D01H 4/10 57/416
4,241,572 A * 12/1980 Le Chatelier ..... D01H 4/10 57/302

(Continued)

FOREIGN PATENT DOCUMENTS

DE 2234422 B1 11/1973
DE 100 24 020 A1 11/2001

(Continued)

OTHER PUBLICATIONS

European Search Report for corresponding European Patent Application No. 16001025.2 dated Oct. 24, 2016.

*Primary Examiner* — Shaun R Hurley
*Assistant Examiner* — Bao-Thieu L Nguyen
(74) *Attorney, Agent, or Firm* — Nelson Mullins Riley & Scarborough LLP

(57) ABSTRACT

A spinning rotor (3) for an open-end spinning device (1) operating in particular at high rotor speeds with a rotor cup (26), having a rotor bottom (6) and an opening (30) and having an annular wall section (31) designed as a fiber sliding wall. The rotor cup (26) in the transitional area between the rotor bottom (6) and the annular wall section (31) has a support collar (9) pointing away from the opening (30) of the rotor cup (26).

2 Claims, 2 Drawing Sheets

(56) References Cited

U.S. PATENT DOCUMENTS 4,299,084 A * 11/1981 Seiki ..... D01H 4/10 57/416
4,513,566 A * 4/1985 Rajsigl ..... D01H 4/12 384/227
4,633,664 A * 1/1987 Mueller-Storz ..... D01H 4/12 57/100
4,777,813 A * 10/1988 Hoffmann ..... B21D 22/14 57/416
5,535,582 A * 7/1996 Paweletz ..... D01H 4/14 310/67 R
5,622,040 A * 4/1997 Preutenborbeck ..... D01H 4/12 192/105 CD
5,718,110 A * 2/1998 Stahlecker ..... D01H 4/10 57/404
5,749,216 A * 5/1998 Lang ..... D01H 4/08 57/406
5,987,871 A * 11/1999 Winzen ..... D01H 4/12 310/90.5
6,033,121 A * 3/2000 Stahlecker ..... D01H 4/12 384/549
6,195,976 B1 * 3/2001 Wassenhoven ..... D01H 4/10 57/414
6,269,623 B1 * 8/2001 Phoa ..... D01H 4/40 57/417
6,986,244 B2 * 1/2006 Burchert ..... D01H 4/10 57/416
7,013,629 B2 * 3/2006 Burchert ..... D01H 4/40 57/416
RE40,759 E * 6/2009 Wassenhoven ..... D01H 4/10 57/414

FOREIGN PATENT DOCUMENTS

DE 10 2005 021 920 A1 11/2006
DE 10 2007 007 260 A1 8/2008
DE 199 10 277 B4 11/2010
EP 0 154 358 A2 9/1985
EP 0 972 868 A2 1/2000

* cited by examiner

SPINNING ROTOR FOR AN OPEN-END-SPINNING DEVICE OPERATING AT HIGH ROTOR SPEEDS

CROSS-REFERENCE TO RELATED APPLICATIONS

This application claims priority from German National Patent Application No. DE 102015007819.4, filed Jun. 18, 2015, entitled "Spinnrotor fur eine mit hohen Rotordrehzahlen arbeltende Offenend-Spinnvorrichtung", the entire contents of which are incorporated herein by reference.

FIELD OF THE INVENTION

The invention relates to a spinning rotor for an open-end-spinning device operating at high rotor speeds with a rotor cup, which comprises a rotor bottom and an opening and has an annular wall section designed as a fiber sliding wall.

BACKGROUND OF THE INVENTION

As already known and described in detail in numerous patent documents, spinning-rotors of open-end-spinning devices generally have a rotor shaft for bearing and driving the spinning rotor and a rotor cup arranged on the rotor shaft for producing a yarn.

In open-end spinning devices which operate at high speeds, of for example greater than 130 000 rpm, the spinning rotors are increasingly equipped with a single drive and mounted magnetically for example.

In such spinning rotors driven with single motors also the rotor shaft is generally designed in two parts, that is the rotor shaft consists of a front part to which the rotor cup is fixed, and a rear part which comprises the rotor-side components of the drive and the magnetic bearing of the spinning rotor.

The two rotor shaft parts are connected to one another during the spinning operation by a coupling device and can be detached from one another if necessary.

As such spinning rotors have to be accelerated again to their operating speed after each interruption in the spinning and the operating speeds of such modern open-end rotor spinning machines, as indicated above, can be greater than 150.000 rpm, it is advantageous if the rotating parts of an open-end rotor spinning device have the lowest possible inertia moment, that is if the spinning rotors are built to be as light as possible.

The high operating speeds of modern open-end rotor spinning machines thus make very high demands on the spinning rotors, both with regard to the radial run-out and bearing which also relates to their speed performance.

In German Patent Publication DE 199 10 277 B4 spinning rotors are described which are used in modern open-end-rotor spinning machines and are designed accordingly for high operating speeds.

Said known spinning rotors comprise rotor cups, which are rotated respectively from a solid material and have an aerodynamically advantageously designed outer surface. The rotor cups of said spinning rotors have an annular wall section, which is designed so that the thickness of the wall section continually increases slightly from the opening of the rotor cup in the direction of the rotor bottom.

The rotor bottom of said spinning rotors is also designed so that the cross-section of the rotor bottom increases from the outside inwardly. This means that such spinning rotors have their greatest thickness in the region of the central connecting collar, in which the front part of the rotor shaft is mounted.

In practice such spinning rotors are also characterized by being highly effective, however at very high speeds of the spinning rotors due to the centrifugal forces occurring in the region of the rotor cups often large material stresses are produced.

Spinning rotors, which can be operated at very high operating speeds and are characterized by high efficiency, are also known from German Patent Publications DE 10 2005 021 920 A1 and DE 10 2007 007 260 A1.

In said literature different joining methods are described by means of which in a spinning rotor, which is driven by a single motor and is mounted magnetically, the rotor cup can be connected reliably to an associated rotor shaft part.

The rotor cups of said spinning rotors are characterized by having a weight-optimised structure, wherein the rotor shaft is designed in two parts.

This means that in these known spinning rotors a first rotor shaft part comprises the rotor side components of the spinning rotor drive and the spinning rotor bearing, whereas the rotor cup is secured on a second rotor shaft part, which if necessary is mounted exchangeably in the first rotor shaft part.

According to German Patent Publication DE 10 2005 021 920 A1 for example the front part of the rotor shaft and the relatively thin-walled rotor cup comprise connecting means which are at least partly cast around by a connecting element designed as a casting. In the cooled state the casting then forms a form-fitting connection between the front rotor shaft part and the rotor cup.

In German Patent Publication DE 10 2007 007 260 A1 a joining method is described in which the thin-walled rotor cup of a spinning rotor can be connected by an adhesive bond directly or indirectly in a rotationally secure manner to a front rotor shaft part.

By means of such an adhesive bond in a relatively simple manner a significant reduction in mass is achieved compared to previously conventional types of connection, with the result that spinning rotors produced in this way are relatively light and can thus be accelerated and braked effectively.

The reduction of the mass inertia moment of the spinning rotor achieved by using an adhesive bond according to the invention not only has a positive effect on the acceleration behaviour of the spinning rotor, but the reduction in weight of the spinning rotors also leads to a reduction in the power consumption which in a textile machine with a plurality of workstations results in a noticeable saving for each machine.

As indicated above, in such spinning rotors, in particular at very high speeds, the material of the rotor cups is subjected to high material stresses.

In order to prevent the overloading of the rotor cup material with occurring centrifugal forces, therefore in practice the speeds, at which such spinning rotors can be operated, are limited for example to 150 000 rpm.

By means of European Patent Publication EP 0 154 358 A2 spinning rotors are also known the rotor cups of which are produced by non-cutting shaping. In these known spinning rotors a cold-rolled fine steel sheet is used as a starting material for the rotor cup, which is shaped by means of suitable tools into a rotor cup.

As in such rotor cups produced by non-cutting shaping there is a risk that because of the high speeds of the spinning rotors high centrifugal forces may lead to deformations of the rotor cups, the rotor cups of such spinning rotors also have a reinforcement in the region of the rotor cup opening.

The reinforcement is thus either designed as a flange arranged in the region of the rotor cup opening, or as a ring, which in the region of the rotor cup opening is fitted onto the outer circumference of the rotor cup.

Also in said spinning rotors, to prevent overloading of the rotor cup material by the centrifugal forces produced, the speeds at which such spinning rotors can be operated are limited.

SUMMARY OF THE INVENTION

On the basis of the aforementioned prior art the invention is based on the objective of developing speed-resistant spinning rotors, that is spinning rotors with which high speeds of greater than 150 000 rpm can be achieved easily and reliably.

Said objective is achieved according to the invention by a spinning rotor, which is characterized in that the rotor cup in the transitional area between the rotor bottom and the annular wall section has a support collar pointing away from the opening of the rotor cup. The rotor bottom can preferably comprise a connecting collar for securing the rotor shaft. Alternatively, the rotor bottom can be designed in one piece with the rotor shaft. Furthermore, preferably the annular wall section can be designed to have a thin wall with a wall thickness of less than 1.5 mm. In this way the inertia moment of the spinning rotor can be reduced advantageously.

In extensive tests, particularly using Finite Element Analysis, it was established that in spinning rotors designed according to the invention the maximum material stresses occurring at high rotor speeds are significantly lower than in spinning rotors known from the prior art.

This means that the design of spinning rotors according to the invention has the advantage that by means of such spinning rotors rotor speeds of over 150 000 rpm can be achieved easily and reliably without the formation of dangerous material stresses in the spinning rotors.

In an advantageous embodiment the support collar is designed as a rotationally symmetrical ring. By means of such a configuration it can be ensured that during the operation of the spinning rotor by the support collar no one-sided centrifugal forces are produced which would result in additional material stressing of the rotor cup.

Preferably, the support collar has an essentially triangular cross-sectional area and is formed in one piece on the rear side of the bottom of the rotor cup.

By means of such a support collar with a triangular cross-sectional area it is possible that even at very high rotor speeds the material stresses in the areas of the spinning rotor at risk are kept within acceptable limits. The increase in weight of the spinning rotor resulting from the support collar and thus its inertia moment only change slightly.

In an advantageous embodiment the support collar has a depth, which is less than a third of the length of the rotor cup. This means in practice that the depth of the support collar is preferably between 2 and 5 mm.

By means of a support collar with such dimensions it is ensured that the spinning rotors are now operationally secure even at speeds of greater than 150 000 rpm, wherein at the same time the power consumption of the textile machine can be kept within acceptable limits.

BRIEF DESCRIPTION OF THE DRAWINGS

The invention is explained in more detail in the following with reference to an example embodiment shown in the drawings, wherein.

DETAILED DESCRIPTION OF THE INVENTION

Figure 1:
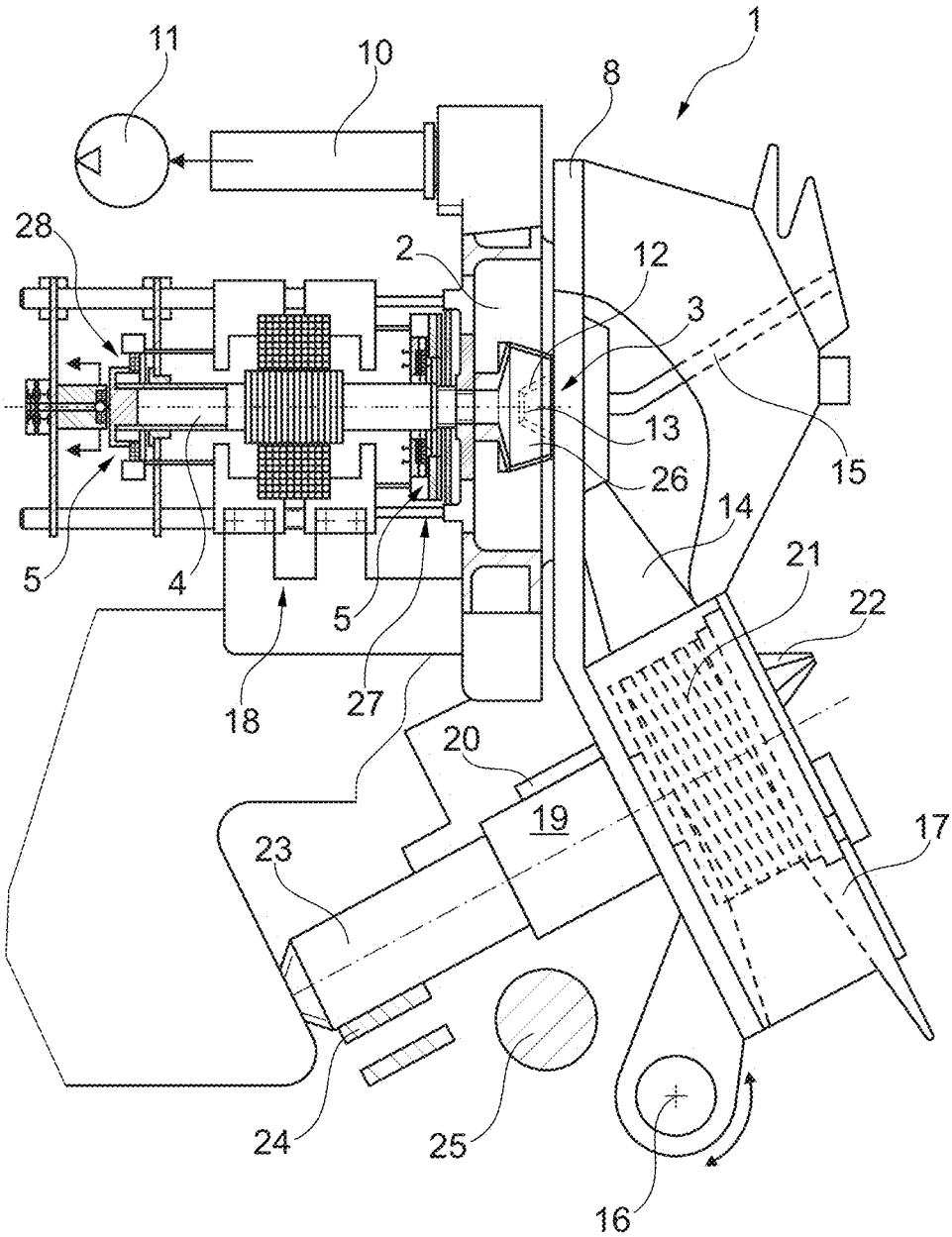
FIG. 1 shows schematically in side view an open-end spinning device with a single-motor driven, magnetically mounted spinning rotor.

FIG. 1 shows an open-end spinning device 1 with a magnetically mounted and single-motor driven spinning rotor 3.

Such open-end spinning devices 1 are already known and described in relative detail for example in European Patent Publication EP 0 972 868 A2.

Such open-end-spinning devices 1 have respectively a rotor housing 2, in which the rotor cup 26 of a spinning rotor 3 rotates at high speed.

The spinning rotor 3 is here preferably driven by an electromotor single drive 18 and is supported with its rotor shaft 4 in front 27 and rear 28 bearing points of a magnetic bearing arrangement 5, which position the spinning rotor 3 in both radial and axial direction.

The rotor housing 2 which is open towards the front is closed during the spinning operation by a pivotably mounted cover element 8 and connected by a suitable pneumatic line 10 to a source of negative pressure 11, which produces the negative spinning pressure required in the rotor housing 2.

In the cover element 8, as already known, a so-called channel plate adapter 12 is formed which comprises the yarn take-off nozzle 13 and the mouth area of the fiber guiding channel 14. A yarn take-off tube 15 is connected as usual to the yarn take-off nozzle 13.

On the cover element 8, which is mounted rotatably in a limited manner about a pivot axis 16, also an opening roller housing 17 is secured. Furthermore, the cover element 8 comprises rear bearing consoles 19, 20 for supporting an opening roller 21 or a sliver draw-in cylinder 22.

The opening roller 21 is driven in the region of its whorl 23 by a rotating, machine-length tangential belt 24, whereas the (not shown) drive of the sliver draw-in cylinder 22 is preferable performed by a worm gear arrangement, which is connected to a machine-length drive shaft 25.

In an alternative embodiment the opening roller 21 and/or the sliver draw-in cylinder 22 can of course, also be driven by a single, for example a stepping motor.

Figure 2:
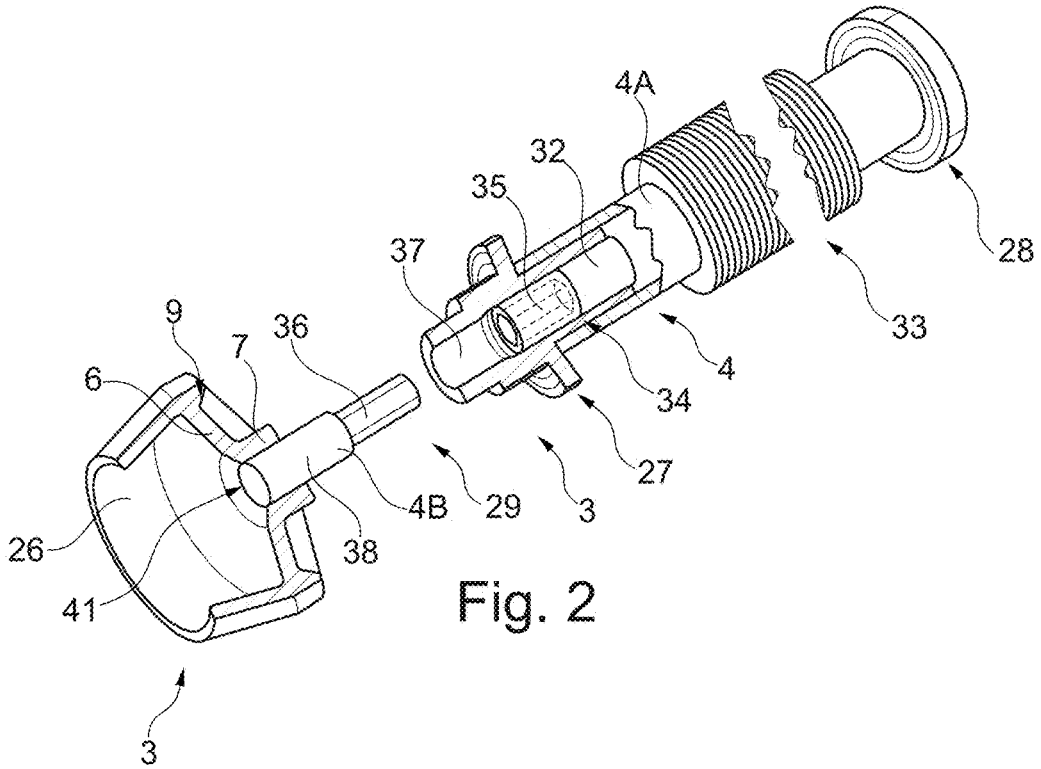
FIG. 2 shows a perspective view of a single-motor driven spinning rotor with a two-part rotor shaft, wherein on the front part of the rotor shaft a rotor cup designed according to the invention is secured.

As already indicated above and shown in FIG. 2 on a larger scale, the spinning rotor 3 of the open-end spinning device 1 is driven by an electric motor driven single drive 18, the rotor-side component of which is denoted by the reference numeral 33.

In order to easily disassemble such spinning rotors 3 if necessary, in particular the rotor cups 26 which are subjected to increased wear, it is known to design the rotor shaft 4 of such spinning rotors in two parts.

This means that the rotor shaft 4 comprises, as shown in the example embodiment, a rear rotor shaft part 4A equipped with the rotor-side magnet bearing components of the front and the rear bearing point 27, 28 and a front rotor shaft part 4B to which the rotor cup 26 is secured.

As explained in detail for example in German Patent Publication DE 100 24 020 A1, the rotor shaft part 4B, to which the rotor cup 26 of the spinning rotor 3 is secured, is connected to the rotor shaft part 4A by an anti-rotational plug-in connection, if necessary detachably.

This means the rotor cup 26 of the spinning rotor 3, which is connected unreleasably to the front rotor shaft section 4A, as shown in FIG. 2, is connected by a coupling device denoted overall by the reference numeral 29 to the rear rotor shaft section 4B.

The coupling device 29 consists for example of a magnet device 32 for axially fixing the components 4A, 4B and a mechanical anti-rotation device 35, 36.

The rotor cup 26 designed as a relatively thin-walled construction comprises in the region of its bottom 6 a connection collar 7 with a bore 41, in which, preferably by means of a press-fit, the front rotor shaft section 4A designed as a connection bolt is secured.

The rotor shaft section 4A is preferably made at least in its end section from a ferromagnetic material and divided into two sections of equal length, preferably a cylindrical guiding section 38 and a section designed as an external polygon 36.

As also shown in FIG. 2, furthermore in the tubular, rear rotor shaft section 4B, for example also by means of a press-fit, a receiving tube 34 is secured which has a rotationally secured internal polygon 35 and permanent magnet insert 32. The rotor shaft section 4B also has a cylindrical bore 37, which in the installed state corresponds with the guiding section 38 of the front rotor shaft section 4A.

Figure 3:
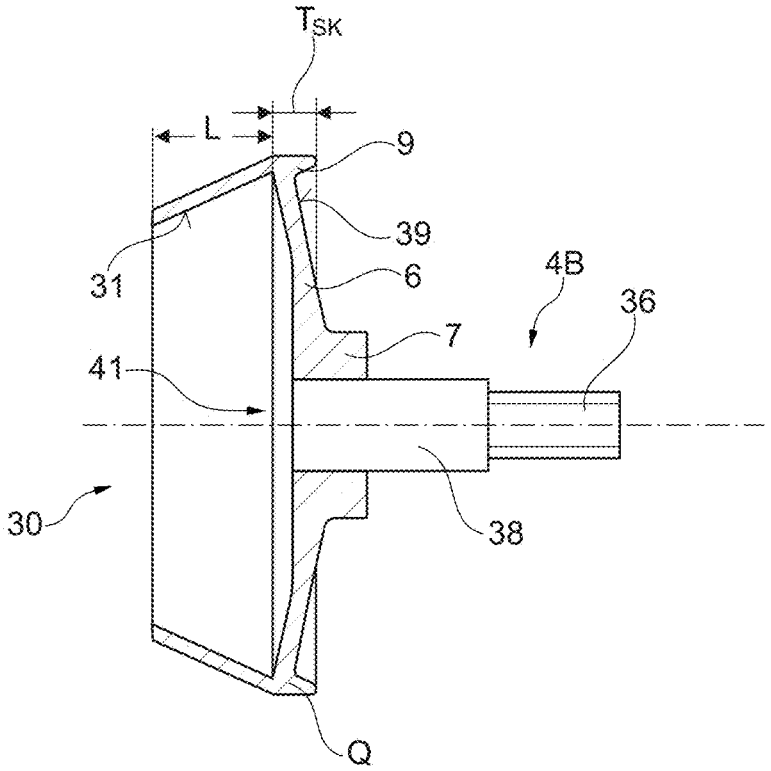
FIG. 3 shows in side view and in cross-section a rotor cup designed according to the invention with the associated front rotor shaft part.

As shown in particular in FIG. 3, the rotor cup 26, as usual, has a front opening 30, a wall section 31 beginning at the opening 30, diverging to the rear and functioning as a fiber sliding wall and a rotor bottom 6 with a connection collar 7 formed thereon.

The rotor cup 26 is designed overall as a relatively thin-walled component and in the region of the wall section 31 has an almost constant wall thickness, whereas in the region of the rotor bottom 6 the wall thickness increases from the outside in.

As already explained above, on the rotor bottom 6 a connection collar 7 is formed in one piece which has a bore 41 for receiving the front rotor shaft section 4B. This means the front rotor shaft section 4B designed as a connection bolt is secured in the bore 41 of the connection collar 7, preferably by means of a press-fit.

The rotor cup 26 also has in the connection area between the wall section 31 and the rotor bottom 6 a support collar 9 according to the invention pointing away from the opening of the rotor cup.

Said support collar 9 is advantageously designed as a rotationally symmetrical ring and has an essentially triangular cross-sectional area (Q).

As shown in particular in FIGS. 2 and 3, the support collar 9 is formed in one piece on the rear side 39 of the rotor bottom 6 of the rotor cup 26 and preferably has a depth ($T_{SK}$), which is less than a third of the length (L) of the rotor cup 26. In practice the depth ($T_{SK}$) of the support collar 9 is preferably between 2 and 5 mm.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Spinning rotor (3) for an open-end-spinning device (1) operating in particular at high rotor speeds, comprising a rotor cup (26), which comprises a rotor bottom (6) and an opening (30) and has an annular wall section (31) designed as a fiber sliding wall, characterized in that the rotor cup (26) in the transitional area between the rotor bottom (6) and the annular wall section (31) has a support collar (9) pointing away from the opening (30) of the rotor cup (26), characterized in that the support collar (9) has a depth ($T_{SK}$) which is less than a third of the length (L) of the wall section (31) of the rotor cup (26).

2. Spinning rotor according to claim 1, characterized in that the depth ($T_{SK}$) of the support collar (9) is between 2 and 5 mm.

* * * * *